US006218772B1

(12) United States Patent
Shimizu et al.

(10) Patent No.: US 6,218,772 B1
(45) **Date of Patent: *Apr. 17, 2001**

(54) COLOR CATHODE-RAY TUBE WITH SHADOW MASK MOUNTING SYSTEM

(75) Inventors: Norio Shimizu; Shinichiro Nakagawa, both of Fukaya; Masatsugu Inoue, Kumagaya, all of (JP)

(73) Assignee: Kabushiki Kaisha Toshiba, Kawasaki (JP)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 09/085,838

(22) Filed: May 28, 1998

(30) Foreign Application Priority Data

May 30, 1997 (JP) ..... 9-141350

(51) Int. Cl.[7] ..... H01J 29/80
(52) U.S. Cl. ..... 313/402
(58) Field of Search ..... 313/402, 403, 313/404, 407, 408

(56) References Cited

U.S. PATENT DOCUMENTS 4,739,216 4/1988 Yamazaki et al. .
4,748,371 5/1988 Bauder .
4,949,009 8/1990 Iwamoto .

FOREIGN PATENT DOCUMENTS 0 187 026 7/1986 (EP) .
6-139949 5/1994 (JP) .
8-255578 10/1996 (JP) .

*Primary Examiner*—Ashok Patel
*Assistant Examiner*—Karabi Guharay
(74) *Attorney, Agent, or Firm*—Oblon, Spivak, McClelland, Maier & Neustadt, P.C.

(57) ABSTRACT

A shadow mask of a color cathode-ray tube includes a substantially rectangular mask main body and a rectangular mask frame attached an outer periphery of the mask main body. The mask main body has a substantially rectangular main surface portion formed of a curved face having a large number of electron beam passage apertures, the main surface portion having a longer axis and a shorter axis perpendicular to the longer axis, and a skirt portion raised in peripheral edges of the main surface portion. The skirt portion has a pair of longer side walls extending substantially in parallel to the longer axis, and a pair of shorter side walls extending substantially in parallel to the shorter axis. Each of the longer side walls includes a pressing portion located near the shorter axis so as to protrude toward the mask frame and pressing the mask frame.

10 Claims, 5 Drawing Sheets

COLOR CATHODE-RAY TUBE WITH SHADOW MASK MOUNTING SYSTEM

BACKGROUND OF THE INVENTION

1. Field of the Invention

The present invention relates to a color cathode-ray tube, and in particular to a color cathode-ray tube which is reduced in microphonic caused by vibration, deformation the at time of shadow mask assembling, and doming caused by thermal expansion of the shadow mask, and which displays images of favorable definition.

2. Discussion of the Background

In general, color cathode-ray tubes have an envelope including a substantially rectangular panel and a funnel. On the inner face of an effective portion formed by a curved face of the panel is formed a phosphor screen which is formed by three-color phosphor layers. On the inside of the phosphor screen, a substantially rectangular shadow mask is arranged to be opposed to the phosphor screen.

In the cathode-ray tube, three electron beams emitted from an electron gun disposed in a neck of the funnel are deflected by a deflection device mounted outside the funnel, and the phosphor screen is subject to horizontal and vertical scanning via the shadow mask. Thereby, a color image is displayed.

The shadow mask is provided to select the three electron beams incident on the three-color phosphor layers. In general, the shadow mask includes a nearly rectangular mask main body, and a nearly rectangular mask frame arranged along the periphery of the mask main body. The mask main body is formed by a curved face opposed to the phosphor screen. In addition, the mask main body includes a main surface portion having a large number of electron beam passage apertures, a nonporous portion located around the main surface portion, and a skirt portion located around the nonporous portion. The skirt portion is joined to side wall portions of the mask frame.

As for the combination of the mask main body and the mask frame, there are such a case that the side wall portions of the mask frame are joined inside the skirt portion of the mask main body, and such a case that the side wall portions are joined outside the skirt portion. Most large-sized tubes have such a structure that the side wall portions of the mask frame are attached outside the skirt portion.

In such a shadow mask, the distances between opposed open edges of the skirt portion in a shorter axis direction and a longer axis direction of the mask main body are set substantially equal to the distances between the side wall portions of the mask frame in the same directions.

In color cathode-ray tubes of recent years, it has been promoted to make an outer face of the effective portion of the panel a flat face or a curved face close to a flat face. In such color cathode-ray tubes, it is necessary to make the inner surface of the effective portion as well flat, as the outer surface of the effective portion is made flat. In the case where the inner surface of the effective portion of the panel is thus made flat, it is necessary to make the curvature of the main surface portion of the mask main body small and make the main surface portion flat or substantially flat, in order to make beam landing for the three-color phosphor layers favorable over the entire face of the screen.

If the curvature of the main surface portion of the mask main body becomes small, however, the tension strength of this main surface portion is lowered. If the color cathode-ray tube is incorporated into a television set in this case, then voice vibration fed from a speaker is transmitted to the mask main body. Because of resultant resonance of the mask main body, howling is apt to occur. The howling significantly degrades the image characteristics.

Furthermore, if the curvature of the main surface portion of the mask main body becomes small and the tension strength falls, then degradation of the color purity is apt to occur because of deformation of the mask main body caused in the manufacturing process of the color cathode-ray tube.

Furthermore, typically in color cathode-ray tubes, the quantity of the electron beams arriving at the phosphor screen via the electron beam passage apertures of the shadow mask is ⅓ or less of the electron beam quantity emitted from the electron gun, because of the operation principle. The rest of the electron beams mainly collide with the mask main body and heat it. Because of resultant thermal expansion of the shadow mask, such doming as to swell in the phosphor screen direction is caused in the mask main body. If the distance between the phosphor screen and the mask main body gets out of its tolerance due to the doming, the beam landing for the three-color phosphor layers deviates and color purity is degraded.

The shift amount of the beam landing caused by the doming largely differs depending upon the brightness of the image pattern, the duration of the pattern, and the like. Especially if a high brightness pattern is displayed locally, then local doming of the mask main body occurs, and local beam landing deviation occurs in a short time. And the local doming of the shadow mask appears especially largely in the case where the curvature of the main surface portion of the mask main body is small.

BRIEF SUMMARY OF THE INVENTION

The present invention has been made in consideration of the above described problems, and its object is to provide a color cathode-ray tube which is reduced in howling, deformation, and local doming of the shadow mask, and which displays images of favorable definition.

In order to achieve the above described object, a color cathode-ray tube according to the present invention comprises an envelope including a panel having a substantially rectangular effective portion, a phosphor screen formed on an inner surface of the effective portion, and a shadow mask arranged in the envelope so as to be opposed to the phosphor screen.

The shadow mask comprises a mask main body including a substantially rectangular main surface portion formed by a curved face having a large number of electron beam passing holes formed therethrough and having a longer axis and a shorter axis perpendicular to the longer axis; and a skirt portion raised in peripheral edges of the main surface portion.

The shadow mask also includes a substantially rectangular mask frame joined to the outer periphery of the skirt portion of the mask main body.

The skirt portion of the mask main body has a pair of longer side walls extending substantially in parallel to the longer axis, and a pair of shorter side walls extending substantially in parallel to the shorter axis.

Each of the longer side walls includes a pressing portion located near the shorter axis to protrude toward the mask frame and pressing the mask frame.

In accordance with the present invention, a length PX of the pressing portion measured in a direction of the longer axis is LX/2 or less, where LX is a length of the main surface portion of the mask main body measured in the direction of the longer axis.

Furthermore, a color cathode-ray tube according to the present invention comprises an envelope including a panel having a substantially rectangular effective portion, a phosphor screen formed on an inner surface of the effective portion, and a shadow mask disposed in the envelope so as to be opposed to the phosphor screen.

The shadow mask includes a mask main body including a substantially rectangular main surface portion formed of a curved face having a large number of electron beam passage apertures and having a longer axis and a shorter axis perpendicular to the longer axis; and a skirt portion raised in peripheral edges of the main surface portion.

The shadow mask also includes a substantially rectangular mask frame joined to an outer periphery of the skirt portion of the mask main body.

The skirt portion of the mask main body has a pair of longer side walls extending substantially in parallel to the longer axis, and a pair of shorter side walls extending substantially in parallel to the shorter axis. Each of the longer side walls includes a pressing portion formed near the shorter axis so as to protrude toward the mask frame and pressing the mask frame to generate residual internal stress in the main surface portion.

Furthermore, a color cathode-ray tube according to the present invention comprises an envelope including a panel having a substantially rectangular effective portion, a phosphor screen formed on an inner surface of the effective portion; and a shadow mask arranged in the envelope and opposing the phosphor screen.

The shadow mask comprises a mask main body including a nearly rectangular main surface portion formed of a curved face having a large number of electron beam passage apertures and having a longer axis and a shorter axis perpendicular to the longer axis; and a skirt portion raised in peripheral edges of the main surface portion. The shadow mask also includes a substantially rectangular mask frame joined to an outer periphery of the skirt portion of the mask main body.

The skirt portion of the mask main body has a pair of longer side walls extending substantially in parallel to the longer axis, and a pair of shorter side walls extending substantially in parallel to the shorter axis. Each of the longer side walls includes a pressing portion formed near the shorter axis to protrude toward the mask frame and pressing the mask frame.

In a part of the main surface portion located near the shorter axis, a curvature in a direction of the shorter axis is greater at a peripheral part of the main surface portion than at a central part of the main surface portion.

In the color cathode-ray tube of the present invention having the above described configuration, the mask frame is pressed by the pressing portions formed on the skirt portion of the mask main body, so that residual internal stress is generated in the main surface portion of the mask main body. As a result, the tension strength of the main surface portion is improved. It thus becomes to reduce the howling of the shadow mask, deformation of the shadow mask during manufacturing, and local doming caused by collision of the electron beams. Therefore, degradation of the color purity caused by them can be suppressed. As a result, it becomes possible to provide a color cathode-ray tube having favorable image characteristics. Especially when applied to a color cathode-ray tube flattened in the outer face of the effective portion of the panel and consequently flattened in the main surface portion of the mask main body, the color cathode-ray tube of the present invention brings about a significant effect.

Additional objects and advantages of the invention will be set forth in the description which follows, and in part will be obvious from the description, or may be learned by practice of the invention. The objects and advantages of the invention may be realized and obtained by means of the instrumentalities and combinations particularly pointed out hereinbefore.

BRIEF DESCRIPTION OF THE SEVERAL VIEWS OF THE DRAWING

The accompanying drawings, which are incorporated in and constitute a part of the specification, illustrate presently preferred embodiments of the invention, and together with the general description given above and the detailed description of the preferred embodiments given below, serve to explain the principles of the invention.

FIGS. 1 to 8 show a color cathode-ray tube according to a first embodiment of the present invention, in which:

FIG. 1 is a sectional view of the color cathode-ray tube,

FIG. 2 is a top view of a mask main body of the color cathode-ray tube,

FIG. 3 is a sectional view taken along a line III—III in FIG. 2,

FIG. 4 is a sectional view showing the mask main body and a mask frame of a shadow mask before assembling, FIG. 5 is a sectional view showing the mask main body and the mask frame of the shadow mask after assembling, FIG. 6 is a diagram for explaining a change in curvature of a curved face of the mask main body occurring between before and after the mask main body is attached to the mask frame, FIG. 7A is a sectional view taken along a line VIIB—VIIB in FIG. 7A, FIG. 8 is a plane view schematically showing the mask main body;

DETAILED DESCRIPTION OF THE PREFERRED EMBODIMENTS

Hereafter, embodiments of a color cathode-ray tube according to the present invention will be described in detail.

Figure 1:
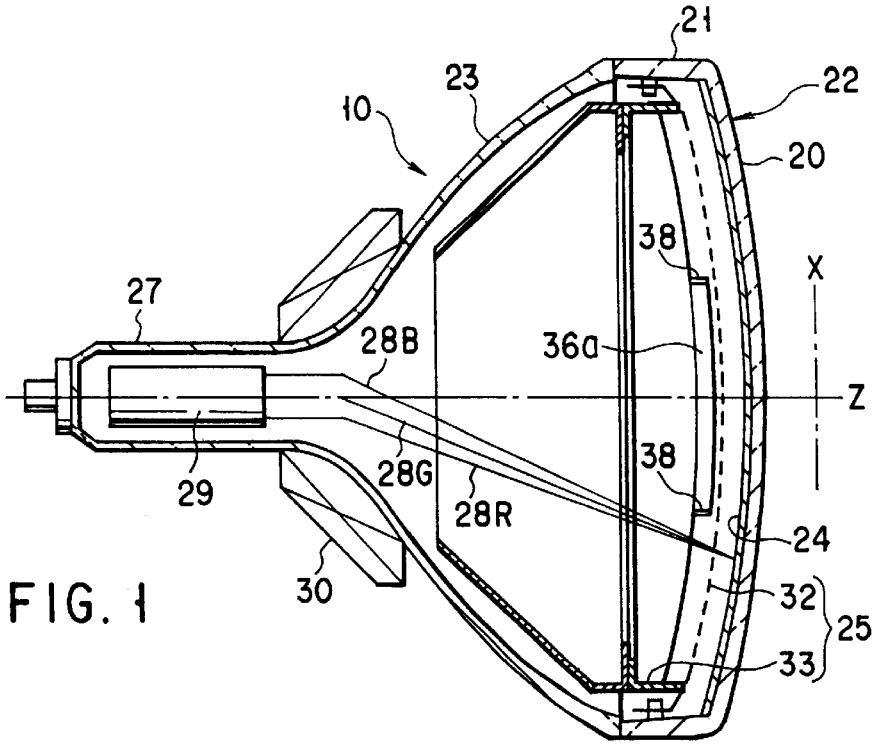

As shown in FIG. 1, the color cathode-ray tube has a vacuum envelope 10. The vacuum envelope 10 includes a substantially rectangular panel 22 and a funnel 23. The panel 22 includes an effective portion 20 formed of a curved face, and a skirt portion 21 provided at the periphery of the effective portion. The funnel 23 is joined to the skirt portion 21. On an inner surface of the effective portion 20 is formed a phosphor screen 24 which includes three-color phosphor layers emitting blue, green, and red light, and light absorbing layers. A substantially rectangular shadow mask 25 described later is arranged inside the phosphor screen 24 with a predetermined interval.

An electron gun 29 for emitting three electron beams 28B, 28G, and 28R is arranged in a neck 27 of the funnel 23. In the color cathode-ray tube, the three electron beams 28B, 28G and 28R emitted from the electron gun 29 are deflected by a magnetic field generated by a deflection device 30, which is mounted outside the funnel 23, to scan the phosphor screen 24 horizontally and vertically via the shadow mask 25. As a result, a color image is displayed.

Figure 2:
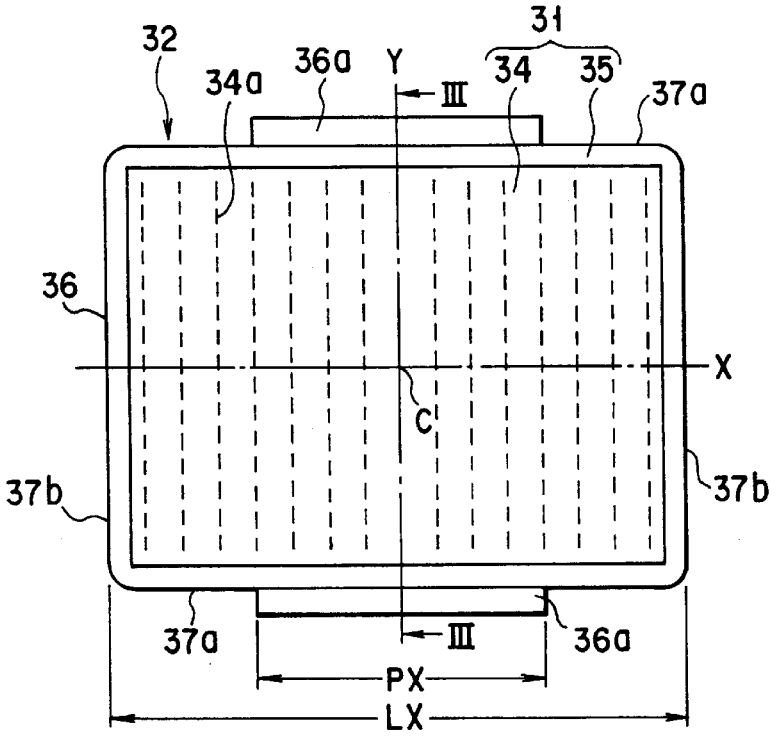
Figure 3:
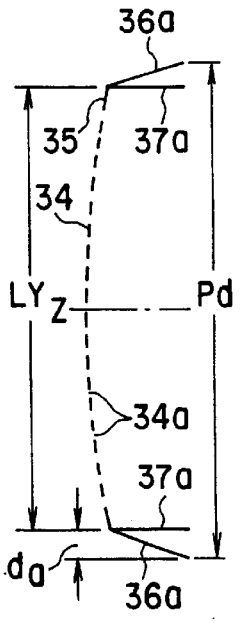

As shown in FIGS. 1 to 3, the shadow mask 25 includes a substantially rectangular mask main body 32 opposed to the phosphor screen 24, and a substantially rectangular mask frame 33 joined to the periphery of the mask main body 32. The shadow mask 25 has a center C through which the tube axis Z of the color cathode-ray tube passes, and a longer axis X and a shorter axis Y passing through the center and perpendicular to each other.

The mask main body 32 integrally includes a substantially rectangular main surface portion 31 formed of a curved face opposing the phosphor screen, and a skirt portion 36 erected along the periphery of the main surface portion. The main surface portion 31 includes a porous portion 34*a* having a large number of electron beam passage apertures 34, and a nonporous portion 35 disposed around the porous portion 34. The skirt portion 36 has one pair of longer side walls 37*a* extending in parallel to the longer axis X, and one pair of shorter side walls 37*b* extending in parallel to the shorter axis Y.

In the present embodiment, a pair of notches 38 are formed in each of the longer side walls 37*a* of the skirt portion 36 with interposing the shorter axis Y between the notches. Each of the notches 38 extends from the periphery of the nonporous portion 35 to the edge of the opening side of the skirt portion. In each longer side wall 37*a*, a part sandwiched between the pair of notches 38 and located near the shorter axis Y is raised so as to protrude outside and form a pressing portion 36*a*. A distance Pd between tips of the pressing portions 36*a* is longer than a length LY of the main surface portion 31 along the shorter axis Y by 2 da (Pd−LY=2 da). A length PX of each pressing portion 36*a* in the direction of the longer axis X satisfies the relation $PX \leqq LX/2$, where LX is the length of the main surface portion 31 measured along the longer axis X. The length PX of each pressing portion 36*a* is suitably set in the range of LX/2 in accordance with the curvature and the tension strength of the curved face of the mask main body 32. Each pressing portion 36*a* is formed symmetrically about the shorter axis Y.

Figure 4:
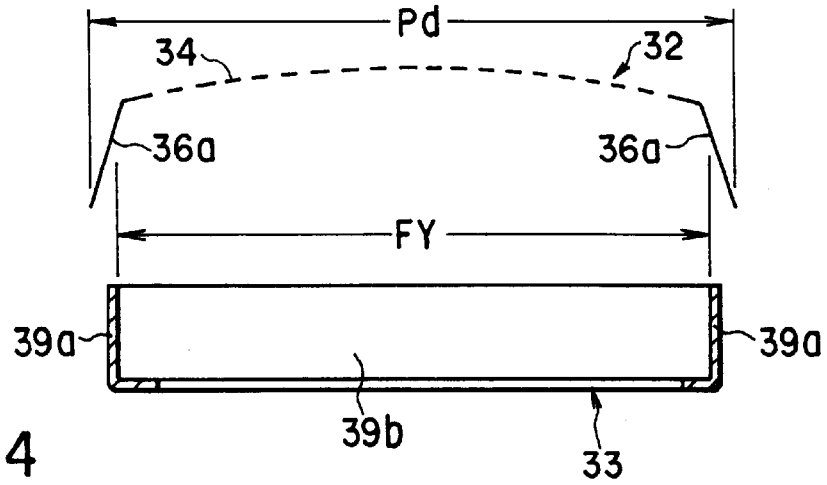

As shown in FIG. 4, the mask frame 33 has a pair of longer side walls 39*a* extending in parallel to the longer axis X, and a pair of shorter side walls 39*b* (only one of the shorter side walls is illustrated) extending in parallel to the shorter axis Y. Each side wall has an inner overhang portion, and has an L-shaped cross section. A distance FY between inner surfaces of the one pair of longer side walls 39*a* along the shorter axis Y is substantially equal to the length LY of the main surface portion 31 of the mask main body along the shorter axis Y. The distance FY is smaller than the distance Pd between the pair of pressing portions 36*a*, that is, FY<Pd.

Figure 5:
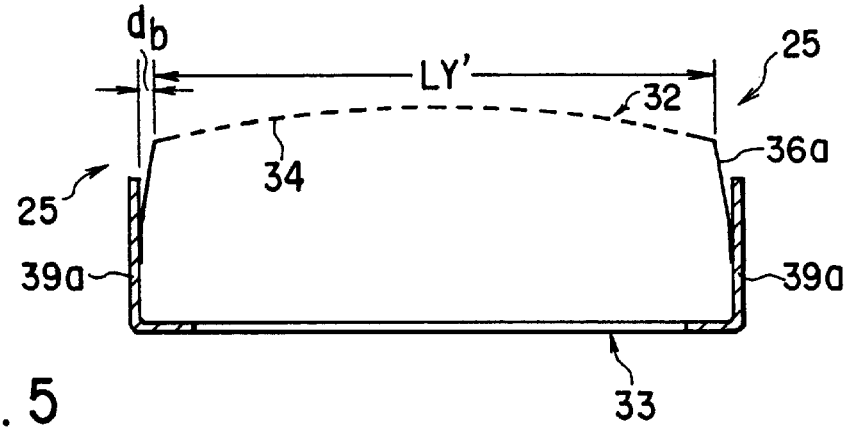

As shown in FIG. 5, in the case where the mask main body 32 is to be joined to the mask frame 33, the pair of pressing portions 36*a* of the mask main body 32 are deformed elastically in such a direction as to make them approach each other, and in this state these pressing portions and other parts of the skirt portion 36 are put into the inside of the longer side walls 39*a* and the shorter side walls 39*b* of the mask frame 33. Then a plurality of regions of the skirt portion 36 are welded to the inner surfaces of the longer side walls 39*a* and the shorter side walls 39*b* of the mask frame 33 to join the mask main body 32 to the mask frame 33. The shadow mask 25 is thus formed. In this state, the pair of pressing portions 36*a* elastically abut against the inner surfaces of the longer side walls 39*a* of the mask frame 33 and press the effective portion 34 of the mask main body from both sides thereof in the direction of the shorter axis Y.

The shadow mask 25 having the above described configuration was used as a shadow mask for color cathode-ray tube, for example, having a screen aspect ratio of 16:9 and a diagonal dimension of 66 cm. The following Table shows the dimensions Pd, LY, FY and PX in this case as compared with the conventional shadow mask.

TABLE

| | Pd (mm) | LY (mm) | FY (mm) | PX (mm) |
|---|---|---|---|---|
| Present embodiment | 337 | 331 | 331 | 250 |
| Prior Art | 331 | 331 | 331 | — |

As shown in the Table, Pd is substantially equal to FY in the conventional shadow mask. In the shadow mask of the present embodiment, however, Pd is significantly larger than FY.

Figure 6:
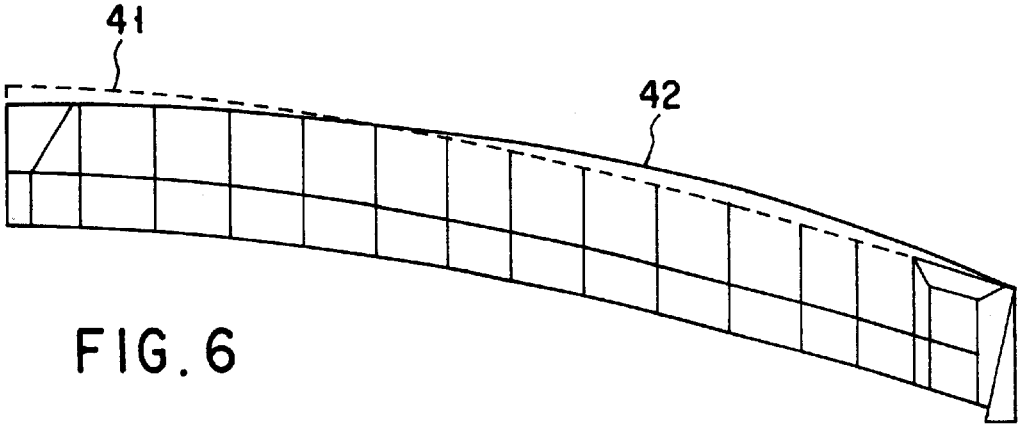

As for the curved face of the main surface portion 31 of the mask main body 32 before attaching it to the mask frame 33, the curvature is large in the center region as illustrated by a broken line 41 in FIG. 6. After joining the mask main body 32 to the mask frame 33, in the curved face of the main surface portion 31, the curvature becomes small in the center region as illustrated by a solid line 42 in FIG. 6, according to a simulation result.

The tension strength of the curved face of the mask main body 32 typically becomes large as the curvature becomes large. Furthermore, it is known that local doming of the shadow mask 25 becomes small as the curvature of the curved surface becomes large.

In the color cathode-ray tube according to the present embodiment configured as described above, the mask main body 32 of the shadow mask 25 has a pair of pressing portions 36*a*. In the direction of the shorter axis Y of the mask main body 32, therefore, the curvature of the main surface portion 31 of the mask main body 32 in the center region after assembling of the shadow mask is smaller at the center region and larger at the region near the periphery of the mask main body than before the mask main body 32 is attached to the mask frame 33, as illustrated by a solid line 42 in FIG. 6.

However, the distance Pd between opening edges of one pair of pressing portions 36*a* is set larger than the distance FY of the longer side walls 37*a* of the mask frame 33. These pressing portions 36*a* are fitted between the longer side walls 37*a* of the mask frame 33 while the distance Pd is compressed. As a result, the longer side walls 37*a* are pressed. Therefore, the pressing portions 36*a* generate large residual internal stress in the curved face of the mask main body 32, increase the tension strength of the curved face of the mask main body, and maintain a strength at a sufficiently high level close to the strength before shadow mask assembling. Furthermore, in the peripheral part of the main surface portion 31 of the mask main body 32, it is possible to increase the curvature and generate the residual internal stress.

Therefore, it is possible to reduce the howling of the shadow mask 25, the deformation of the shadow mask in the manufacturing process of the color cathode-ray tube, and local doming of the mask main body 32 caused by collision of the electron beams, and it is possible to effectively suppress the degradation of the color purity. As a result, a color cathode-ray tube having favorable image characteristics can be provided.

Figure 7A:
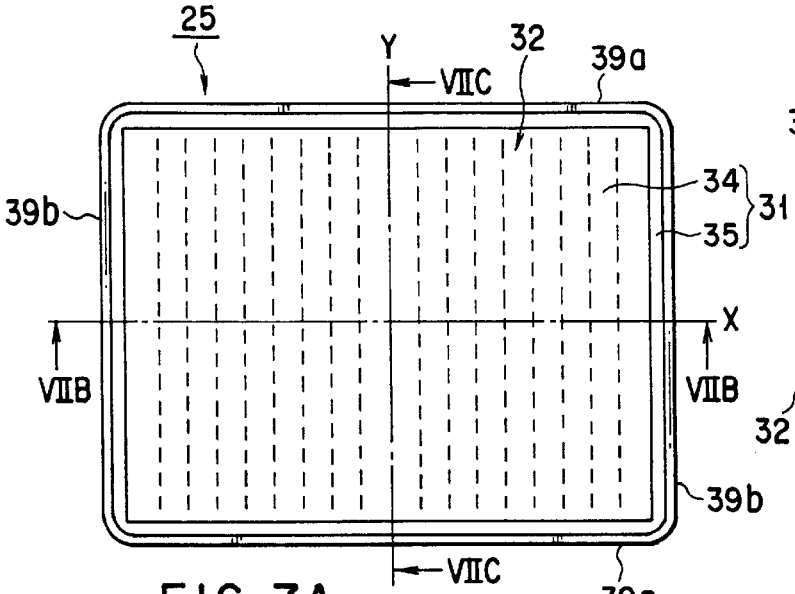
FIG. 7A is a plane view of the above described shadow mask.
Figure 7C:
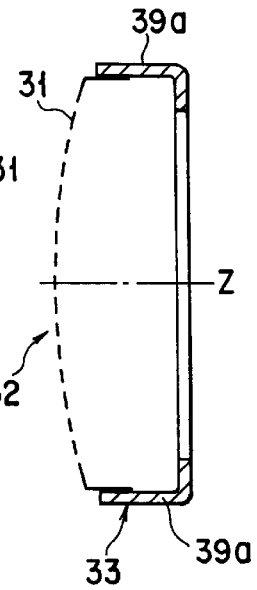
FIG. 7C is a sectional view taken along a line VIIC—VIIC in FIG. 7A.
Figure 7B:
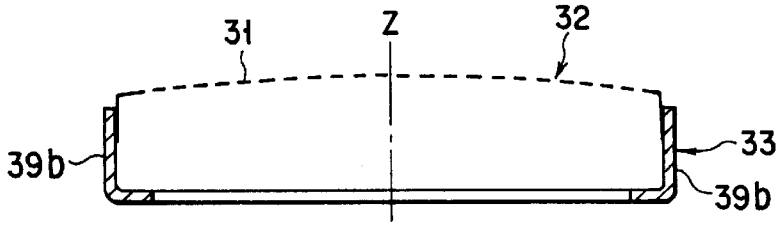

Furthermore, the shadow mask 25 in the present embodiment is formed so that the curvature of the mask main body along the shorter axis Y will become larger than that along the longer axis X in the central region of the mask main body 32, as shown in FIGS. 7A to 7C. In this case, the doming suppression effect of the mask main body 32 can be improved.

Figure 8:
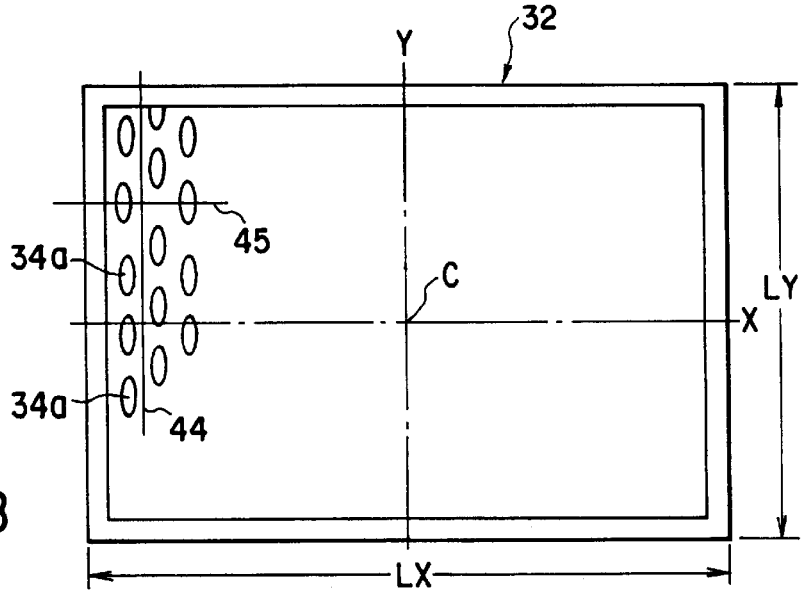

As shown in FIG. 8, this is owing to the fact that the dimension LY of the main surface portion 31 of the mask main body 32 in the direction of the shorter axis Y is shorter than the dimension LX thereof in the direction of the longer axis X, and to anisotropy of the shadow mask 25. In other words, in the case where, in the mask main body 32, a large number of electron beam passage apertures 34*a* are formed in rows in a direction parallel to the short axis Y, a plurality of continuous straight bridge portions 44 extending in the direction of the shorter axis Y and having no electron beam passage apertures 34*a* are present. In the direction of the longer axis X, however, a continuous straight bridge portion is not present as represented by a line 45. Therefore, the shadow mask 25 has anisotropy. If the curvature values are substantially equal, therefore, increasing the curvature of the short axis direction brings about a larger doming suppression effect.

Furthermore, when the shadow mask 25 is applied to a color cathode-ray tube in which the external face of the effective portion 20 of the panel 22 is made to be substantially flat or a curved face close to flat in order to improve the visual recognition, and consequently the main surface portion 31 of the mask main body is flattened, a significant effect is obtained. Furthermore, when the shadow mask 25 is applied to a color cathode-ray tube having an aspect ratio of 16:9 which is long sideways, a significant effect is obtained.

A length LY' of the main surface portion 31 of the mask main body 32 in the direction of the shorter axis Y after assembling of the shadow mask 25 as shown in FIG. 5 is shorter than the distance FY between the inner surfaces of the opposed side wall portions 39 of the mask frame 33 by about 2 db. The magnitude of db is set to a value required to hold the curved face of the mask main body 32 which is needed to accurately land the electron beams on the phosphor screen through the electron beam passage apertures 34*a* of the mask main body 32.

A color cathode-ray tube according to a second embodiment of the present invention will now be described.

Figure 9A:
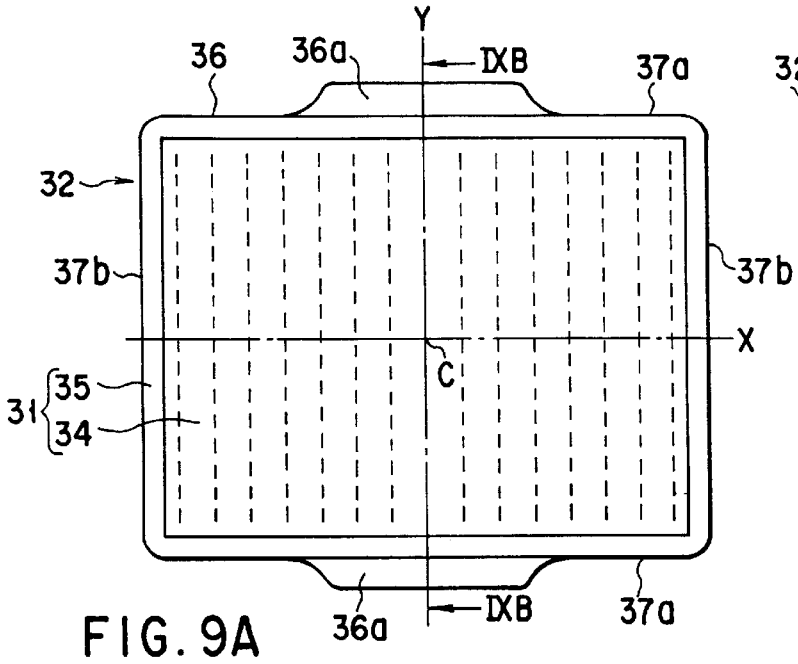
FIG. 9A is a plane view of a mask main body in a color cathode-ray tube according to a second embodiment of the present invention.
Figure 9B:
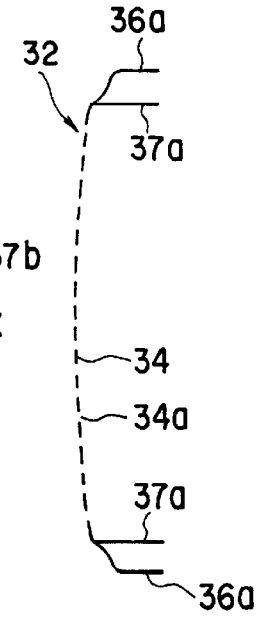
FIG. 9B is a sectional view taken along IXB—IXB in FIG. 9A.

In the above described first embodiment, each pressing portion 36*a* of the mask main body 32 is formed by forming a pair of notches 38 in each of the longer side walls 37*a* of the skirt portion 36 with interposing the shorter axis Y of the mask main body 32 between the notches and raising the portion sandwiched between the pair of notches to protrude outside. In the second embodiment, as shown in FIGS. 9A and 9B, each pressing portion 36*a* is formed by making a portion of the longer side wall 37*a* of the skirt portion 36 located near the short axis Y protrude outside smoothly by press molding or the like.

Figure 10A:
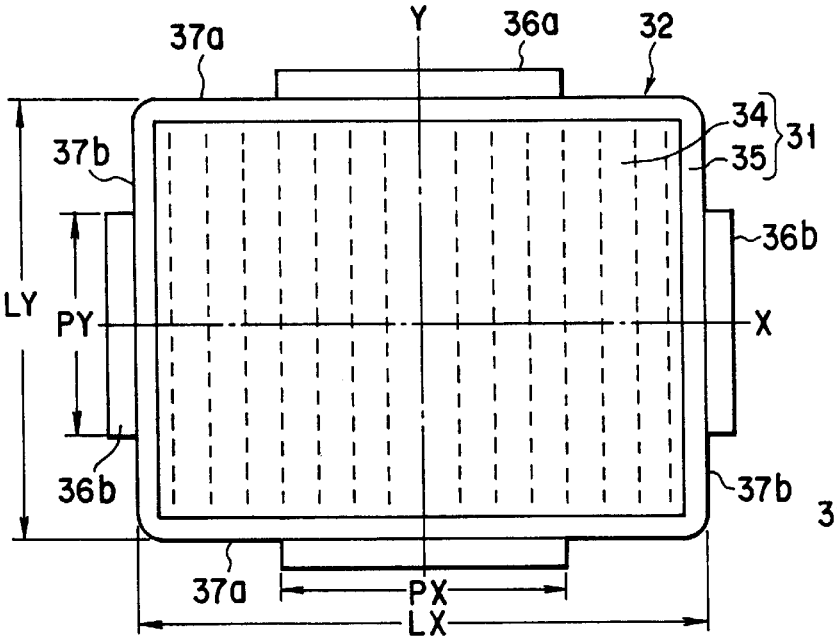
FIG. 10A is a plane view of a mask main body in a color cathode-ray tube a third embodiment of according to the present invention.
Figure 10C:
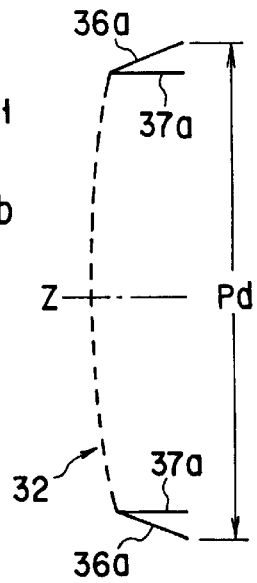
FIG. 10C is a sectional view of the mask main body taken along the Y-axis in FIG. 10A.
Figure 10B:
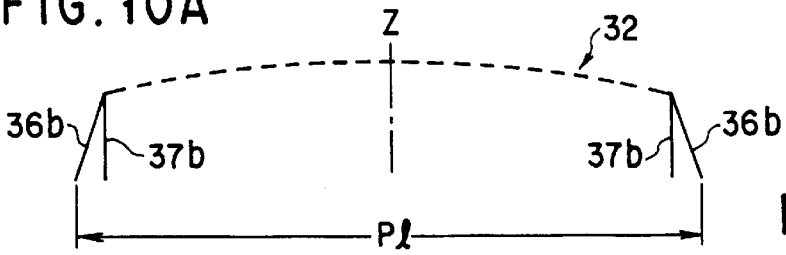
FIG. 10B is a sectional view of the mask main body taken along the X-axis in FIG. 10A.

In the first and second embodiments, the pressing portions 36*a* are provided only on parts of the mask main body 32 located near the shorter axis Y, that is, only on the longer side walls 37*a* of the skirt portion 36. As in a third embodiment shown in FIGS. 10A to 10C, however, pressing portions 37*b* may also be formed on those portions of the mask main body 32 which are located near the longer axis X, that is, on the shorter side walls 37*b* of the skirt portion 36. In this case, each pressing portion 36*b* is formed, in the same way as the pressing portion 36*a*, by forming a pair of notches, which are not illustrated, in each of the shorter side walls 37*b* on both sides of the longer axis X and raising the portion sandwiched between the pair of notches to protrude outside. As for the skirt portion 36 located near the longer axis X, a distance PI between opening edges of the pair of pressing portions 36*b* is set larger than the length LX of the main surface portion 31 of the mask main body measured along the longer axis X, that is, P1>LX. Furthermore, a length PY of each pressing portion 36*b* in the direction of the shorter axis Y is set so as to satisfy the relation $PY \leqq LY/2$, where LY is the length of the main surface portion 31 in the direction of the shorter axis Y. The length PY of the pressing portion 36*b* is suitably set in the range of LY/2 in accordance with the curvature and the tension strength of the main surface portion 31. The pressing portions 36*b* are formed symmetrically about the longer axis X.

The configuration of remaining portions are the same as that of the above described embodiments. The same portions are denoted by like reference numerals, and detailed description of them will be omitted.

In the third embodiment of the above described configuration as well, operation effects similar to those of the first embodiment can be obtained. Specifically, by providing the pressing portions 36*a* and 36*b* on the mask main body 32, it is possible to generate large residual internal stress in the main surface portion 31 of the mask main body by the action of the pressing portions and enhance the tension strength of the main surface portion, when the mask main body is attached to the mask frame 33. Further-more, when the shadow mask 25 is applied to a color cathode-ray tube in which the external face of the effective portion of the panel is made to be substantially flat or a curved face close to flat in order to improve the visual recognition, and consequently the main surface portion of the mask main body is flattened, a significant effect is obtained. Furthermore, when the shadow mask 25 is applied to a color cathode-ray tube incorporating a large-sized shadow mask, a significant effect is obtained.

Figure 11A:
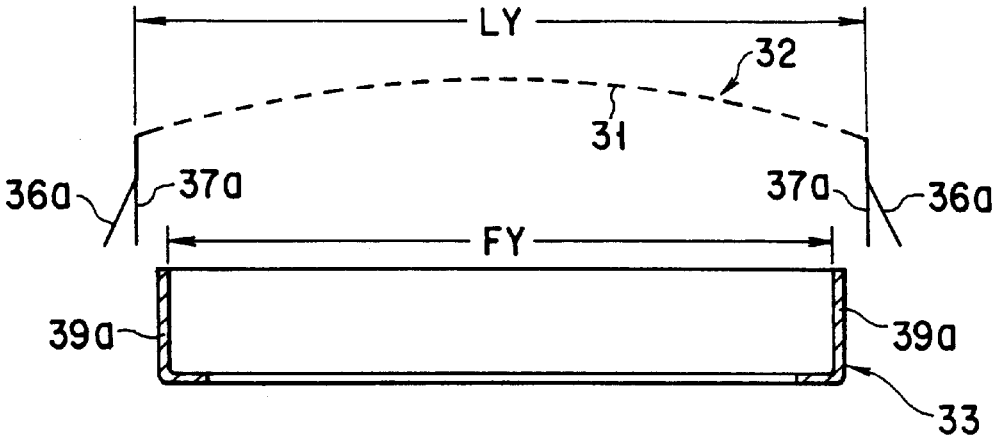
FIG. 11A is a sectional view showing a mask main body and a mask frame before assembling a shadow mask according to a modification of the present invention.
Figure 11B:
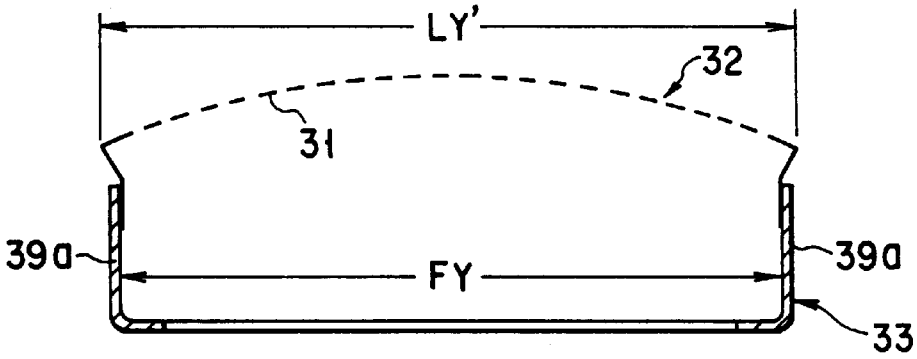
FIG. 11B is a sectional view showing the mask main body and the mask frame of the shadow mask after assembling.

The present invention is not limited to the above described embodiments, but within the scope of the present invention, various modifications can be applied. For example, in the above described embodiment, the length LY' of the main surface portion of the mask main body in the direction of the shorter axis Y after assembling of the shadow mask is set shorter than the distance FY between a pair of longer side walls 39*a* of the mask frame 33. Alternatively, the mask main body 32 may be constructed so that the length LY of the main surface portion 31 of the mask main body 32 in the direction of the shorter axis Y, before assembling of the shadow mask 25, is slightly greater than the distance FY between the inner surfaces of the longer side walls 39*a* of the mask frame 33 as shown in FIG. 11A, and the length LY' of the main surface portion 31 in the direction of the shorter axis Y, after assembling the shadow mask, is shorter than the length LY in the direction of the shorter axis Y before assembling. In this case, it is a matter of course that the distance Pd between the opening edges of the pair of pressing portions 36*a* provided on the skirt portion 36 of the mask main body 32 is set greater than the distance FY between the inner surfaces of the longer side walls 39*a* of the mask frame 33.

Furthermore, the main surface portion 31 of the mask main body 32 may be formed so as to be greater than the distance between the inner surfaces of the shorter side walls 39*b* of the mask frame 33 not only in the direction of the shorter axis Y but also in the direction of the longer axis X.

Additional advantages and modifications will readily occur to those skilled in the art. Therefore, the invention in its broader aspects is not limited to the specific details and representative embodiments shown and described herein. Accordingly, various modifications may be made without departing from the spirit or scope of the general inventive concept as defined by the appended claims and their equivalents.

What is claimed is:

1. A color cathode-ray tube comprising:

an envelope including a panel having a substantially rectangular effective portion;

a phosphor screen formed on an inner surface of the effective portion; and a shadow mask arranged in the envelope and opposing the phosphor screen;

the shadow mask including:

a mask main body having a substantially rectangular main surface portion formed of a curved face having a large number of electron beam passage apertures, the main surface portion having a center through which a tube axis passes, a longer axis and a shorter axis passing through the center and perpendicular to each other, and a skirt portion raised in peripheral edges of the main surface portion; and a substantially rectangular mask frame being joined to an outer periphery of the skirt portion of the mask main body, the skirt portion of the mask main body having a pair of longer side walls extending substantially in parallel to the longer axis, and a pair of shorter side walls extending substantially in parallel to the shorter axis; and each of the longer side walls including a pressing portion located at a region through which the shorter axis passes the pressing portion protruding toward the mask frame and pressing the mask frame so as to generate residual internal stress in the main surface portion.

2. A color cathode-ray tube according to claim 1, wherein a length PX of the pressing portion in a direction of the longer axis is LX/2 or less, where LX is a length of the main surface portion of the mask main body in the direction of the longer axis.

3. A color cathode-ray tube according to claim 2, wherein the pressing portions are formed symmetrically about the shorter axis.

4. A color cathode-ray tube according to claim 1, wherein the main surface portion of the mask main body has, near its center, a curvature along the shorter axis greater than a curvature along the longer axis.

5. A color cathode-ray tube according to claim 1, wherein each of the longer side walls of the skirt portion has a pair of notches formed on both sides of the shorter axis, and the pressing portion is formed by bending that portion of the skirt portion which is located between the notches to outside.

6. A color cathode-ray tube according to claim 1, wherein each of the pressing portions is formed by pressing.

7. A color cathode-ray tube according to claim 1, wherein each of the shorter side walls of the skirt portion has another pressing portion formed near the longer axis so as to protrude toward the mask frame and pressing the mask frame.

8. A color cathode-ray tube comprising:

an envelope including a panel having a substantially rectangular effective portion;

a phosphor screen formed on an inner surface of the effective portion; and a shadow mask arranged in the envelope opposing the phosphor screen;

the shadow mask comprising;

a mask main body having a substantially rectangular main surface portion formed of a curved face having a large number of electron beam passage apertures, the main surface portion having a center through which a tube axis passes, a longer axis and a shorter axis passing through the center and perpendicular to each other, and a skirt portion raised in peripheral edges of the main surface portion; and a substantially rectangular mask frame being joined to an outer periphery of the skirt portion of the mask main body, the skirt portion of the mask main body having a pair of longer side walls extending substantially in parallel to the longer axis, and a pair of shorter side walls extending substantially in parallel to the shorter axis, and each of the longer side walls including a pressing portion formed at a region through which the shorter axis passes, the pressing portion protruding toward the mask frame and pressing the mask frame so as to generate residual internal stress in the main surface portion, the mask main body being so formed that curvature of the mask main body, in a region of the mask main body located near the shorter axis, in a direction in parallel to the shorter axis is smaller at a center region and larger at a peripheral portion than before the mask main body is attached to the mask frame.

9. A color cathode-ray tube comprising:

an envelope including a panel having a substantially rectangular effective portion;

a phosphor screen formed on an inner surface of the effective portion; and a shadow mask arranged in the envelope and opposing the phosphor screen;

the shadow mask including:

a mask main body having a substantially rectangular main surface portion formed of a curved face having a large number of electron beam passage apertures, the main surface portion having a longer axis and a shorter axis perpendicular to the longer axis, and a skirt portion raised in peripheral edges of the main surface portion; and a substantially rectangular mask frame being joined to an outer periphery of the skirt portion of the mask main body, the skirt portion of the mask main body having a pair of longer side walls extending substantially in parallel to the longer axis, and a pair of shorter side walls extending substantially in parallel to the shorter axis, each of the longer side walls including a pressing portion located near the shorter axis so as to protrude toward the mask frame and pressing the mask frame, and the main surface portion of the mask main body having, near its center, a curvature along the shorter axis greater than a curvature along the longer axis.

10. A color cathode-ray tube comprising:

an envelope including a panel having a substantially rectangular effective portion;

a phosphor screen formed on an inner surface of the effective portion; and a shadow mask arranged in the envelope and opposing the phosphor screen;

the shadow mask including;

a mask main body having a substantially rectangular main surface portion formed of a curved face having a large number of electron beam passage apertures, the main surface portion having a longer axis and a shorter axis perpendicular to the longer axis, and a skirt portion raised in peripheral edges of the main surface portion; and a substantially rectangular mask frame being joined to an outer periphery of the skirt portion of the mask main body, the skirt portion of the mask main body having a pair of longer side walls extending substantially in parallel to the longer axis, and a pair of shorter side walls extending substantially in parallel to the shorter axis, each of the longer side walls including a pressing portion located near the shorter axis so as to protrude toward the mask frame and pressing the mask frame, and wherein each of the longer side walls of the skirt portion has a pair of notches formed on both sides of the shorter axis, and the pressing portion is formed by bending that portion of the skirt portion which is located between the notches to outside.

* * * * *